United States Patent [19]

Goodfellow

[11] Patent Number: 4,751,117

[45] Date of Patent: Jun. 14, 1988

[54] FABRIC FROM A BLEND OF CARIBOU HAIR AND WOOL

[76] Inventor: Robin Goodfellow, 16-796 Wolseley Avenue, Winnipeg, Manitoba, Canada, R3G 1C6

[21] Appl. No.: 12,273

[22] Filed: Feb. 9, 1987

[30] Foreign Application Priority Data

Feb. 7, 1986 [CA] Canada ..... 501379

[51] Int. Cl.[4] ..... A01N 1/00

[52] U.S. Cl. ..... 428/16; 428/15; 428/85; 428/97; 428/259; 428/280

[58] Field of Search ..... 428/16, 15, 85, 97, 428/259, 280

[56] References Cited

U.S. PATENT DOCUMENTS 755,219 3/1904 Davison ..... 428/97

*Primary Examiner*—Marion C. McCamish

*Attorney, Agent, or Firm*—Adrian D. Battison; Stanley G. Ade

[57] ABSTRACT

A novel fabric is formed as a carded blend of hair from an animal in the group consisting of *Rangifer tarandus* (Caribou), *Odocoileus hemonus* (Mule Deer) and *Odocoileus virginiana* (White Tailed Deer) and wool. The blend includes between 27% and 33% of the hair and is formed by felting or weaving using a wool warp.

9 Claims, No Drawings

FABRIC FROM A BLEND OF CARIBOU HAIR AND WOOL

BACKGROUND OF THE INVENTION

This invention relates to a novel fabric formed from a novel blend of fibers.

Hair from various animals, particularly cold weather animals, has a peculiar construction formed with air-filled cells which has evolved as a very effective way of insulating the animal from the surrounding cold environment. In particular *Rangifer tarandus* (Caribou or Reindeer) is a very common animal in northern climates and has hair particulary noted for its insulating properties due to the presence of air-filled cells. In addition *Odocoileus hemonus* (Mule Deer) and *Odocoileus virginiana* (White Tailed Deer) have very similar hair properties.

While hair of this type has been noted as having very high insulating properties, it has not been formed into a fabric in view of the other properties of the hair which make it unacceptable in fabric construction. Particularly the hair is relatively short and very fragile having very low tensile strength and a low resistance to damage by friction or by various forms of processing. It also has a very high electrostatic propensity.

While large numbers of such animals are slaughtered each year for meat and other materials, in most cases the hair or fur is discarded because of the problems in processing the hair into a useable fabric. To date it is believed that no useable fabric has been developed using this hair and therefore it is one object of the present invention to provide a novel fabric employing this hair.

SUMMARY OF THE INVENTION

According to the invention, therefore, there is provided a fabric consisting of a mixture of wool and between 20% and 33%, by weight, of hair removed without cutting from an animal from one of the group consisting of *Rangifer tarandus, Odocoileus hemonus* and *Odocoileus virginiana.*

For the first time, therefore, a useable fabric has been developed by the surprising combination of the hair from this group of animals combined with wool in which the wool provides sufficient strength and processability and supports the hair which in turn provides a very high level of insulation properties.

Instead of merely being discarded, therefore, the hair can be used to provide a useful fabric particularly in an area where resources are low and the requirement for insulation very high.

Preferably the fibers forming the fabric are blended and carded and are subsequently felted or spun and woven to form the fabric. In felting the hair must be retained below boiling temperature and hence many felting techniques cannot be used. However, conventional felting techniques are available from the wool art which can be used to felt the hair and the wool into an acceptable non-woven fabric. Alternately the blended fibers can be used as a fill without felting or other processing.

The felt preferably has a proportion of hair to wool by weight providing 33% of hair. Any greater proportion than this would reduce the strength of the fabric beyond an acceptable level. A portion significantly less than this proportion would compromise the insulating properties of the Caribou hair. The felted product can be used for linings for jackets, boots and mits and linings for sleeping bags. It can be used lined or unlined either as merely a filler or as a felt type fabric which has sufficient strength to act as a liner for other articles of clothing or other equipment as outlined above. A very lofty warm felt is produced which is almost twice as insulating as pure wool. Due to reduced elasticity, it resists being shaped but can be sewn without a bulky weft.

When formed by spinning, the carded blend of wool and hair is formed into a yarn having a proportion of hair to wool of the order of 25%–33%. The yarn can then used as a weft with a pure wool yarn as a warp. Alternately the yarn can be used in the warp as a 2-ply yarn which gives the necessary strength. The yarn can be dyed and provides interesting effects in the blend. When woven with the wool warp, the fabric can be used for garments or for example blankets and can be lined or unlined as required. A fine yarn can be used as a "hinge" weft between the spun yarn larger wefts. Alternately, the blended yarn as weft can be usd with other yarns as warp such as linen for tapestries and the like.

It has been found surprisingly that the insulation effect of the hair can seriously be reduced if the hair is removed from the animal skin by cutting and thus the hair should be scraped off mechanically after the skin has been left to sour for a period of time. Souring can be achieved simply by soaking in water for a period of several days, or can be advanced by suitable chemical additives applied to the flesh side of the hide. Both processes leave the hide available for tanning.

Uncut, the hair retains its effective insulating properties. The optimum time of year for harvest of the hair is in the early Spring, approximately February, since before this the hair has not fully matured in width and is not as long.

The blend of fibers thus provides an effective fabric which has high insulating properties and yet provides the necessary strength for use as an effective fabric. The very low density of the hair significantly modifies the fabric from a conventional wool fabric or from a conventional wool blend fabric. The distinctive appearance differences between the wool and hair provide a highly attractive yarn of unique appearance.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A textile product consisting of a mixture of wool and between 20% and 33% by weight of hair removed without cutting from an animal from one of the group consisting of *Rangifer tarandus, Odocoileus hemonus* and *Odocoileus virginiana.*

2. The invention according to claim 1 wherein the hair and the wool are blended by carding.

3. The invention according to claim 1 wherein the proportions by weight lie in the range 27 to 33% of said hair and 73% to 67% of wool.

4. The invention according to claim 1 wherein the hair is removed from the animal's skin by scraping after action on the skin to cause souring.

5. The invention according to claim 1 wherein the hair during processing is retained below boiling temperature.

6. The invention according to claim 1 wherein the product consists of a fabric formed by felting.

7. The invention according to claim 1 wherein a fabric is formed by weaving with a weft provided by a yarn consisting of the product.

8. The invention according to claim 7 wherein the fabric is formed by weaving and includes a warp wholly of wool yarn.

9. The invention according to claim 1 wherein the product is a pile material formed solely by blending the hair and wool.

* * * * *